US006401262B2

(12) United States Patent
Bacchiega

(10) Patent No.: US 6,401,262 B2
(45) Date of Patent: Jun. 11, 2002

(54) PROTECTION IMPLEMENT, PARTICULARLY FOR USE IN SPORTS PRACTICE

(75) Inventor: Flavio Bacchiega, Montebelluna (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 09/834,938

(22) Filed: Apr. 16, 2001

(30) Foreign Application Priority Data

May 18, 2000 (IT) ..... TV00A0052

(51) Int. Cl.[7] ..... A41D 13/12; A42B 3/00
(52) U.S. Cl. ..... 2/456; 2/411
(58) Field of Search ..... 2/411, 412, 455, 2/456

(56) References Cited

U.S. PATENT DOCUMENTS 4,280,342 A * 7/1981 Eng et al.
5,385,036 A * 1/1995 Spillane et al.
5,887,453 A * 3/1999 Woods
5,924,140 A * 7/1999 Chi
6,012,178 A * 1/2000 Schuster et al.

FOREIGN PATENT DOCUMENTS

| | | |
|---|---|---|
| EP | 564246 | * 10/1993 |
| EP | 874076 | * 10/1998 |
| FR | 2566632 | * 1/1986 |
| GB | 2046080 | * 11/1980 |
| JP | 2000037495 | * 2/2000 |
| WO | 9632620 | * 10/1996 |

* cited by examiner

*Primary Examiner*—Rodney M. Lindsey
(74) *Attorney, Agent, or Firm*—Guido Modiano; Albert Josif; Daniel O'Byrne

(57) ABSTRACT

A protection implement, particularly suitable for sports applications, constituted by at least one first outer protective element which is advantageously rigid and optionally by one or more second elastically compressible elements which are arranged internally. At least one third element, advantageously constituted by a two-sided vertical-warp knitted fabric, is arranged below the at least one first outer protective element.

6 Claims, 2 Drawing Sheets

PROTECTION IMPLEMENT, PARTICULARLY FOR USE IN SPORTS PRACTICE

BACKGROUND OF THE INVENTION

The present invention relates to a protection implement which is particularly suitable for the practice of sports such as, for example, car racing, motorcycling, cycling, skiing and skating.

The protections currently used in the practice of those sports are generically constituted by an outer protective shell which is rigid so as to withstand the impacts and collisions to which the athletes may be subjected during sports practice.

One or more paddings can be associated with said outer shell and are optionally covered with appropriate linings in order to improve aesthetic appearance and user comfort.

Such paddings act as deformable and compressible elements, so as to cushion and partially dampen the impact forces acting on the outer shell.

The paddings or linings can be associated with fastening means, so as to allow to fasten and immobilize the protection on the part of the body to be protected.

Those conventional protections are therefore a compromise between the user's need for safety, which is inherent in the impact-resistance and abrasion-resistance properties of the outer shell, and the user's need for comfort.

In most of the conventional protections, the result of this compromise privileges the safety aspect: accordingly, the main drawback of said protections is linked to the almost complete lack of ventilation openings or of transpiration members, thereby causing sweating at the protected regions of the body.

Another drawback of conventional protections is that the materials used for the paddings do not provide, in most cases, a high impact cushioning capacity and it is therefore necessary to make the paddings of considerable thickness and dimensions.

SUMMARY OF THE INVENTION

The aim of the present invention is therefore to solve the above noted problems, eliminating the drawbacks of the known art, by providing a protection implement which allows to achieve optimum breathing at the regions of the body that are covered by such protection.

Within this aim, an important object is to provide a protection implement which allows to achieve a high impact cushioning capacity, thus allowing to use more compact protections with an equal effectiveness.

Another important object is to provide a protection implement which allows to easily modify, during manufacture, the technical and structural characteristics of the protection.

Still another object is to provide a protection implement which is structurally simple and has low manufacturing costs.

This aim and these and other objects which will become better apparent hereinafter are achieved by a protection implement, particularly for sports applications, comprising at least one first outer protective rigid element, characterized in that it comprises at least one fabric element constituted by a two-sided vertical-warp knitted fabric.

BRIEF DESCRIPTION OF THE DRAWINGS

Further characteristics and advantages of the protection implement will become better apparent from the following detailed description of a particular embodiment thereof, illustrated only by way of non-limitative example in the accompanying drawings, wherein.

DESCRIPTION OF THE PREFERRED EMBODIMENTS

Figure 1:
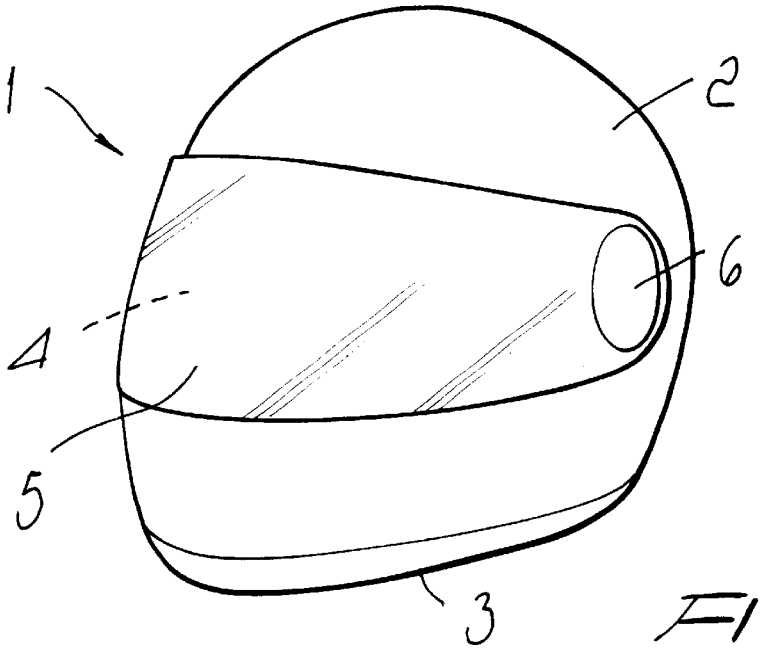
FIG. 1 is a perspective view of a crash helmet.
Figure 2:
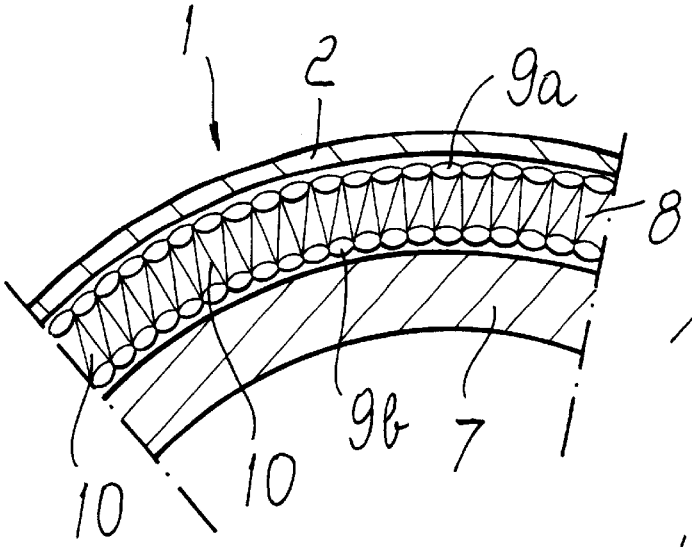
FIGS. 2 and 3 are sectional partial views of two different embodiments of the shell of a crash helmet according to the invention.
Figure 3:
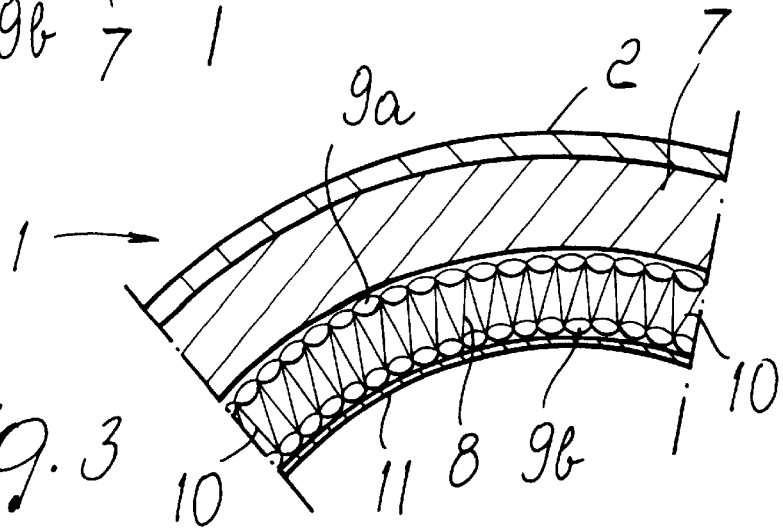

With reference to FIGS. 1 to 3, 1 designates a protection, constituted by a crash helmet in this particular embodiment, which is particularly suitable for the practice of sports such as for example car racing, motorcycling and skiing.

Such helmet 1 comprises at least one first protective element 2 which is arranged externally so as to constitute a protective shell which surrounds the user's head and is made of rigid material, so as to have a high resistance to the impacts and abrasions to which it can be subjected during the practice of said sports.

Such first protective element 2 internally has a substantially spherical shape, with a first lower opening 3, for the insertion of the user's head, and a second opening 4, at the eyes, in order to allow the external view.

Such second opening 4 can be shielded by a visor 5, made of transparent material so as to protect the eyes from the air and against impact with any blunt objects without hindering vision.

The visor 5 is preferably rotatably associated with said first protective element 2, by way of rotary coupling means, constituted for example by two pivots, designated by the reference numeral 6, which are arranged along the same rotation axis at the two opposite sides of the helmet 1.

At least one second elastically compressible element, designated by the reference numeral 7, is optionally arranged inside said first protective element 2 and can be for example a padding designed to contribute to the cushioning of impacts while ensuring an adequate degree of comfort for the user.

At least one third element, designated by the reference numeral 8 and constituted by a two-sided vertical-warp knitted fabric, can be conveniently arranged above or below said second elastically compressible element 7, as shown respectively in FIGS. 2 and 3, or directly in contact with the first protective element 2.

Said sides can be constituted by two bands of knitted fabric, designated by the reference numerals 9*a* and 9*b*, being spaced one another.

A plurality of straight filler threads, generally designated by the reference numeral 10, lie between said bands 9*a* and 9*b* and are joined in said knitted fabric bands 9*a* and 9*b*.

For example, the spacing knitted fabric disclosed in EP-529671, and here incorporated by reference, for the provision of a laminated textile material can be used as a third element 8; said knitted fabric has no filler and is elastically deformable.

The third element 8 can be, for example, of the filler-free elastically deformable type, or can be partially embedded in, or coated with, at least one layer of plastic material, such as for example foamed polyurethane or polystyrene, suitable to modify its deformability.

If the third element 8 is in direct contact with the user's head, a lining, for example, designated by the reference numeral 11 in FIG. 3, may be interposed. The lining is preferably made of transpiring material in order to provide better comfort for the user.

Use of the invention is therefore as follows: with reference to FIG. 3, it can be noted that the third element 8 performs an effective impact cushioning action and can further considerably increase the ventilation capacity proximate to the region of the body that is in contact with the protection 1.

The passage of the air through the lining 11 and its circulation inside the vertical-warp knitted fabric is allowed by the very shape of the third element 8, which allows the user to enjoy greater comfort and considerable relief due to the breathing allowed by the protected part surface.

Any use of various types of covering material for said threads 10 and said bands of knitted fabric 9*a* and 9*b* allows to easily change the mechanical characteristics of the protection 1, obtaining the appropriate structure for each application.

It has thus been found that the invention has achieved the intended aim and objects, a protection implement having been devised which allows to achieve optimum breathing at the regions of the body that are covered by said protection.

Said protection implement further allows to achieve a high impact cushioning capacity and thus allows to use more compact protective elements with equal effectiveness.

The protection implement according to the invention is susceptible of numerous modifications and variations, within the scope of the appended claims.

Figure 4:
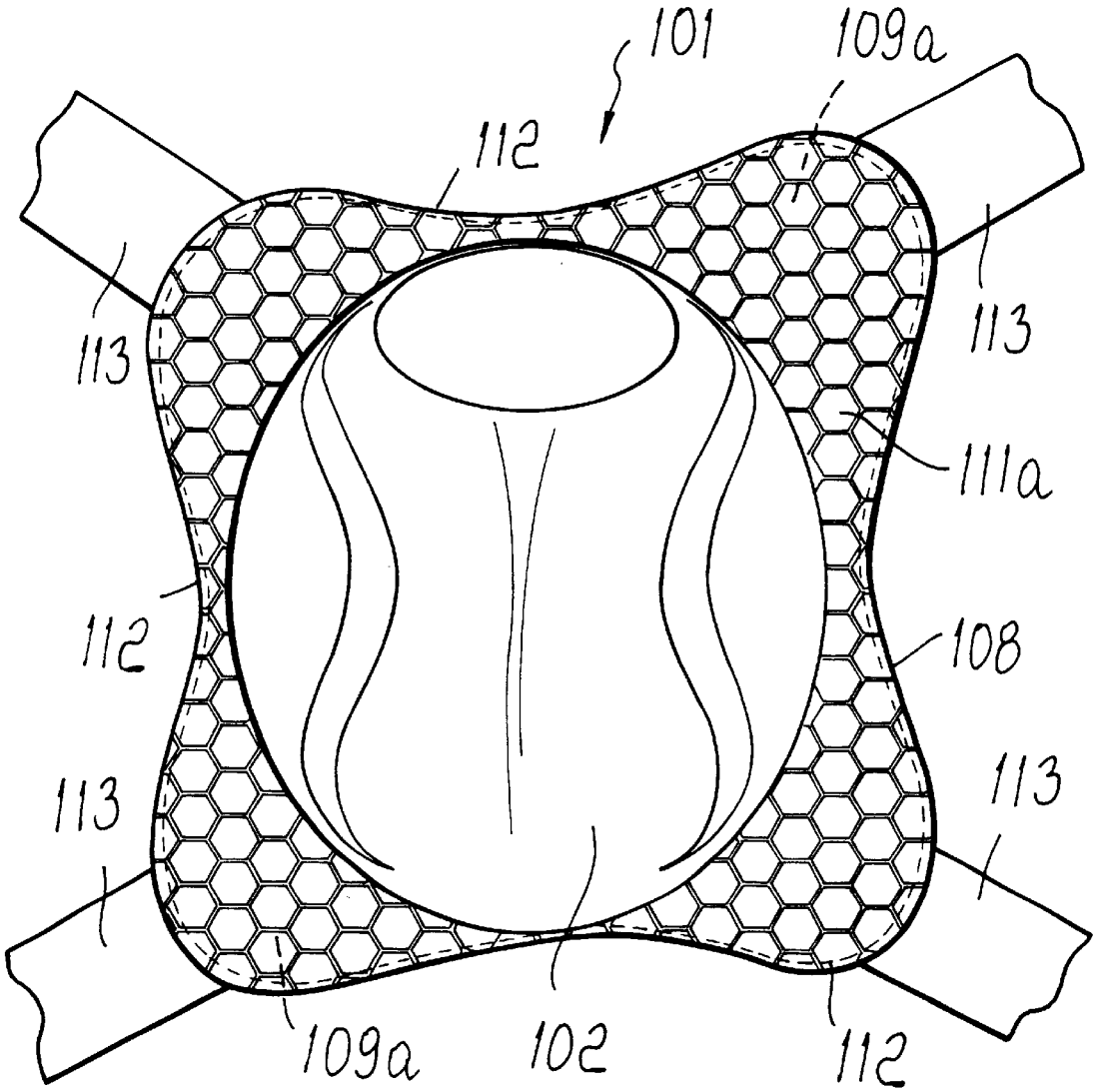
FIG. 4 is a top view of a protection implement for parts of the human body.
Figure 5:
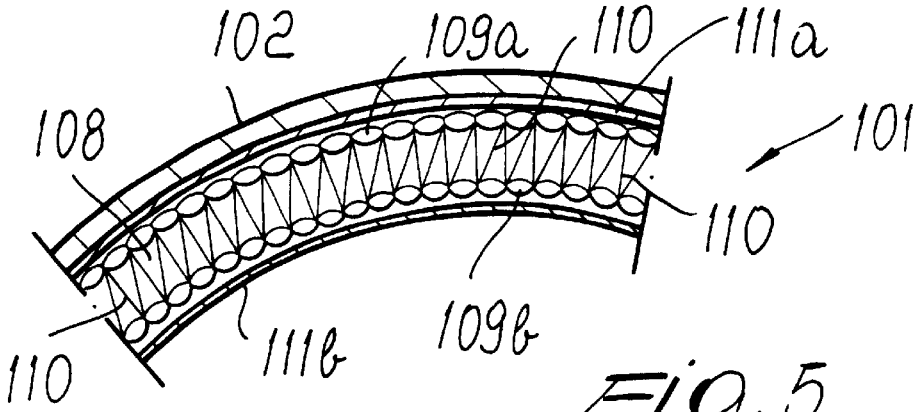
FIG. 5 is a sectional partial view of a particular embodiment of the protection implement shown in FIG. 4.

Thus, for example, FIGS. 4 and 5 illustrate a protection implement 101 for different parts of the body, such as for example the knees, elbows and shoulders, particularly but not exclusively suitable to be used in sports such as motorcycling, hockey and roller skating.

Said protection implement 101 comprises at least one first protective element 102 which is arranged externally and is made of rigid material, so as to have high resistance to the impacts and abrasions to which it can be exposed during the practice of such sports.

Said first protective element 102, which is shaped appropriately according to the protective function that it must perform, is associated with at least one third element, designated by the reference numeral 108, which is constituted by a two-sided vertical-warp knitted fabric.

The sides are constituted by two bands of knitted fabric, designated by the reference numerals 109*a* and 109*b*, which are arranged at a certain distance from each other.

A plurality of straight filler threads, generally designated by the reference numeral 110, lie between said bands 109*a* and 109*b* and are meshed in with said knitted fabric bands 109*a* and 109*b*.

In this embodiment also, it is possible to use as a third element 108 a spacing knitted fabric which has no filler and is elastically deformable, such as the one described in EP-529671.

The third element 108 can be used without a filling or can be covered with at least one layer of plastic material which is suitable to modify its mechanical characteristics, such as deformability, flexibility, rigidity and elasticity.

Two linings, designated by the reference numerals 111*a* and 111*b*, are arranged above and below said third element 108 and are joined to the third element 108 at their perimetric edge 112 so as to cover said third element 108, leaving free the lateral thickness of the third element 108 so as to facilitate air circulation.

The connection between the lining 111*a* and the first protective element 102 can be provided by known methods, such as for example gluing, sewing or fixing by way of temporary connection means, such as strips made of a material known by the trademark Velcro, buttons, press-studs, metallic hooks, etcetera.

It is further possible to provide for the insertion of one or more second elastically compressible elements, such as for example appropriate paddings for absorbing impacts and increasing the degree of comfort, which can be arranged on either side of third element 108.

Third element 108 can also be embedded in one or more second elastically compressible elements or can be arranged so as to obtain the shape and mechanical characteristics that are most suitable for the intended application.

One or more fixing means, designated by the reference numeral 113 in FIG. 4, can be associated with the third element 108 or with the two linings 111*a* and 111*b*, so as to allow the arrangement and fastening of the protection implement 101 at the part of the body to be protected.

The materials used and the dimensions that constitute the individual components of the invention may of course be more pertinent according to specific requirements. The disclosures in Italian Patent Application No. TV2000A000052 from which this application claims priority are incorporated herein by reference.

What is claimed is:

1. A protection implement, particularly for sports applications, comprising at least one first outer protective rigid element, further comprising at least one fabric element constituted by a two-sided vertical-warp knitted fabric.

2. The protection implement according to claim 1, wherein said fabric element is interposed between said at least one first outer protective element and at least one second elastically compressible element.

3. The protection implement according to claim 1, wherein said fabric element is interposed between said at least one second elastically compressible element and an underlying lining which is adapted to be in contact with the region of the body to be protected.

4. The protection implement according to claim 3, wherein it is constituted by a crash-helmet comprising said at least one first outer protective element, so as to constitute a protective shell surrounding the user's head and said at least one second elastically compressible element, arranged internally, and wherein said fabric element is arranged at said at least one second elastically compressible element or directly in contact with said first protective element.

5. The protection implement according to claim 1, comprising two linings which are joined to said fabric element at their peripheral edge and are suitable to cover said fabric element so as to leave free the lateral thickness of the fabric element in order to facilitate air circulation.

6. The protection implement according to claim 1, wherein fabric element is connected to fastening means, so as to allow the arrangement and fastening of said protection implement at the part of the body to be protected.

* * * * *